US007736469B2

(12) United States Patent
Taylor

(10) Patent No.: US 7,736,469 B2
(45) Date of Patent: Jun. 15, 2010

(54) PRODUCTION OF HYDROCARBON FUEL

(75) Inventor: John Taylor, 20 Cedar Grove, Amersham, Buckinghamshire (GB) HP7 9BG

(73) Assignee: John Taylor, Amersham (GB)

( * ) Notice: Subject to any disclaimer, the term of this patent is extended or adjusted under 35 U.S.C. 154(b) by 531 days.

(21) Appl. No.: 10/580,243

(22) PCT Filed: Nov. 19, 2004

(86) PCT No.: PCT/EP2004/053028

§ 371 (c)(1),
(2), (4) Date: Feb. 20, 2007

(87) PCT Pub. No.: WO2005/054409

PCT Pub. Date: Jun. 16, 2005

(65) Prior Publication Data

US 2007/0272537 A1 Nov. 29, 2007

(30) Foreign Application Priority Data

Nov. 21, 2003 (GB) ..... 0327128.0

(51) Int. Cl.
*C10B 57/04* (2006.01)
*C10C 1/20* (2006.01)

(52) U.S. Cl. ..... 201/25; 201/30; 208/179; 208/184; 196/46; 196/46.1; 196/98

(58) Field of Classification Search ..... 201/25, 201/30; 208/179, 184; 196/46, 46.1, 98
See application file for complete search history.

(56) References Cited

U.S. PATENT DOCUMENTS

| | | | | | |
|---|---|---|---|---|---|
| 3,954,602 | A | * | 5/1976 | Troesch et al. | 208/179 |
| 4,666,587 | A | * | 5/1987 | Martin | 208/184 |
| 4,919,793 | A | | 4/1990 | Mallari et al. | |
| 5,049,258 | A | * | 9/1991 | Keim et al. | 208/184 |
| 5,271,808 | A | * | 12/1993 | Shurtleff | 196/46 |
| 5,286,349 | A | * | 2/1994 | Shurtleff | 196/46 |
| 5,527,449 | A | * | 6/1996 | Brown et al. | 208/179 |
| 5,711,870 | A | | 1/1998 | Storm et al. | |
| 5,871,618 | A | * | 2/1999 | Lee et al. | 196/46.1 |
| 5,885,444 | A | * | 3/1999 | Wansbrough et al. | 208/179 |
| 2007/0039240 | A1 | * | 2/2007 | Carroway | 44/393 |

FOREIGN PATENT DOCUMENTS

| | | |
|---|---|---|
| EP | 0 940 463 A2 | 9/1999 |
| WO | WO 95/14069 A1 | 5/1995 |

* cited by examiner

*Primary Examiner*—N. Bhat
(74) *Attorney, Agent, or Firm*—Sughrue Mion, PLLC

(57) ABSTRACT

A process for converting animal fats and/or other feedstocks into gas oil fuel including the steps of introducing material including the animal fats into a still pot in the form of liquor, extracting a volume of material from the still pot, heating the extracted material to a cracking temperature, reintroducing the extracted material back into the still pot, separating the lighter molecular weight compounds from the cracked material into a small fraction of volatile light ends and a second mixture of gas oil fuel in a distillation column collecting the second mixture of gas oil fuel by means of a condenser.

19 Claims, 1 Drawing Sheet

PRODUCTION OF HYDROCARBON FUEL

This invention is directed towards the art of converting animal-by-product fats, vegetable oils, used fossil oils and other liquid hydrocarbons, from a feedstock to a useable fuel source.

Animal fats and other feedstocks retain a high potential energy. They have historically been used as animal and human feedstuffs or as a raw fuel in process industries. However, specific health risks and legislation associated with their collection, storage and transport has led to a ban in their use except for limited and licensed applications.

Although prior art provides for the limited processing of animal fats and other feedstocks into other products, there remains a need for improvement within the art to convert the feedstocks to a high quality liquid energy fuel having a known and repeatable specification.

It is an object of this invention to provide an apparatus and process for the low temperature, low-pressure cracking of animal fats and other feedstocks into a gas oil product by pyrolysis.

It is yet another object of this invention to provide for a process where the conversion of animal fats and other feedstocks to a gas oil fuel product, complies with environmental regulations.

According to the present invention, there is provided a process for converting animal fats and/or other feedstocks into gas oil fuel including the steps of:

introducing material including the animal fats into a still pot in the form of liquor, extracting a volume of material from the still pot, heating the extracted material to a cracking temperature, reintroducing the extracted material back into the still pot, separating the lighter molecular weight compounds from the cracked material into a small fraction of volatile light ends and a second mixture of gas oil fuel in a distillation column collecting the second mixture of gas oil fuel by means of a condenser.

Preferably, a first volume of liquid is extracted from the still pot at a first level, heated to above the cracking temperature while being kept at a sufficiently high pressure to remain in a balanced gas/fluid state, and the gas so formed is injected back into the still pot beneath the surface level of the liquid in the still pot. The first volume of extracted liquid is preferably heated to approximately 280-400 deg C.

The first volume of extracted liquid may be extracted from the still pot from a first level and re-introduced to the still pot at a second level higher than the first level.

A second volume of liquid may be extracted from the still pot from a level higher than the first level at which the first volume of liquid is extracted.

The intention of the invention is to impart heat to a given volume of feedstock, as quickly as possible to promote the cracking of a range of compounds and for process efficiency. It has been found that animal fats and other feedstocks can be cracked under low temperature, low severity pyrolysis conditions to yield a gas oil. This process occurs at temperatures that permit the continuous flow processing of animal fats and other feedstocks into a gas oil fuel without coking or fouling of the pyrolysis apparatus.

However, the process must be controlled, so that heat is not imparted so quickly that hot spots (coking) can occur within the feedstock or in the process apparatus. Conversely, a more gradual imparting of heat over a longer period of time would promote the production of higher volumes of light end gases, to the detriment of efficiency in producing the required medium compound gases. It is partly the intention of the process to restrict the formation of light ends.

The thermal cracking pyrolysis process uses low temperature cracking temperatures (in the range 280-400 deg.C. at low pressure to generate a column distilled fraction of gas oil mixed with light ends. The light ends are flashed off to produce a high quality gas oil having characteristics similar to that of a diesel fuel. By pressurising a feedstock within the process, a higher temperature can be achieved before gases are given off. This is an advantage where the temperature at which light end gases start to form, can be raised to that point where medium compound gases also form and the production of all gases can therefore be more closely regulated within a given temperature range. In effect, by controlling the production of gases so that they are formed within a pressure vessel, a more even temperature gradient can be maintained throughout the heat recovery device (HRD) and localized coking is less likely to occur.

By allowing the gases that are produced, to be injected into the still pot below the level of liquor in the still pot, the kinetic energy of the pressurised gas generates a mixing/agitation of the liquor while at the same time imparting heat by efficient liquid to liquid transfer. This achieves a faster transmission of beat to the liquor without the potential attendant risks of coking. The gases may be injected into the still pot above the level of the liquor, but the heat transfer will be less efficient.

Having the capability to alter the pressure and temperature at which specific gas compounds are formed means that feedstocks with differing chemical compositions can be more efficiently processed into their constituent compounds.

Figure 1:
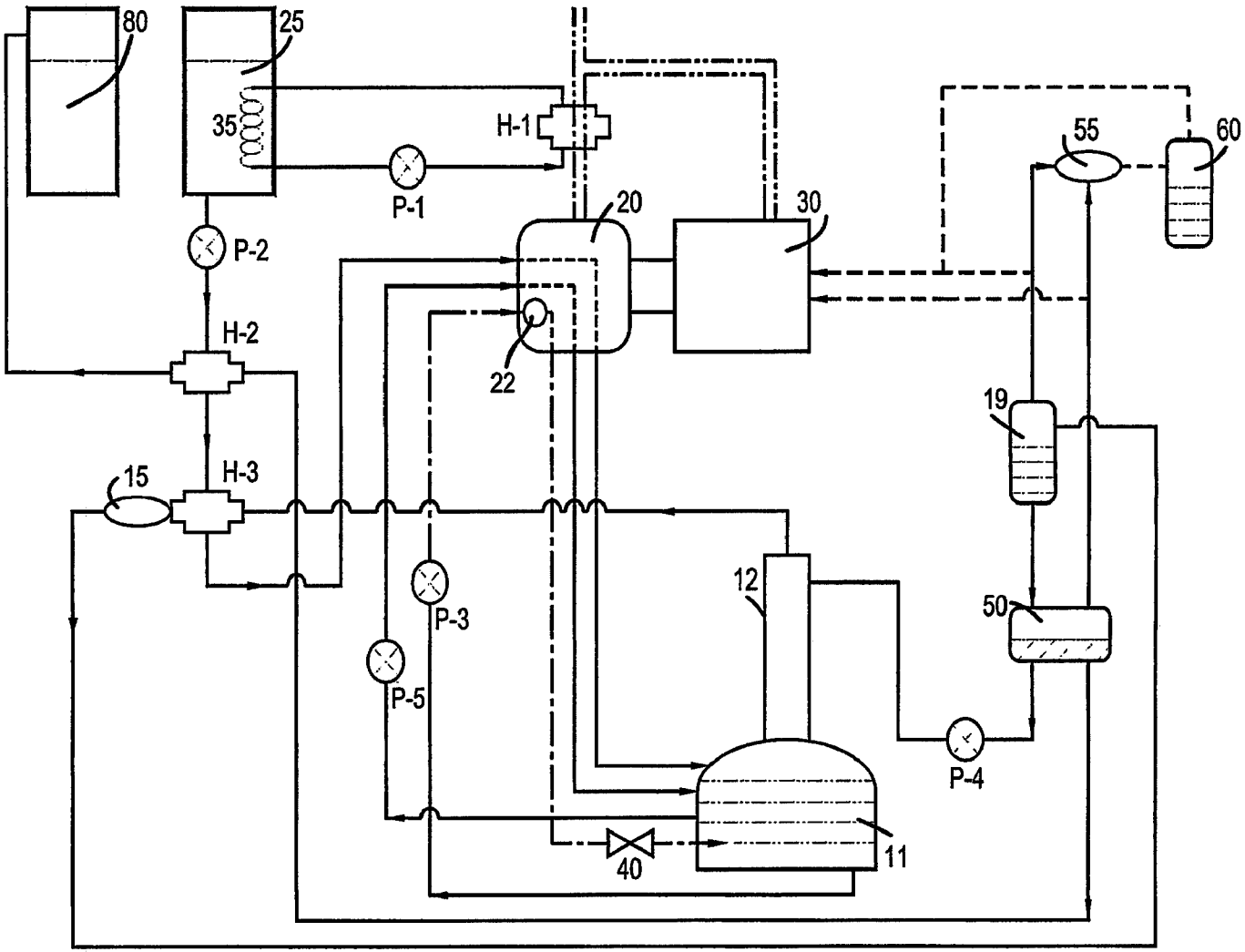
FIG. 1 is a schematic of the process and apparatus.

The process may be utilised for processing animal fats such as tallow, greases and other liquid hydrocarbons feedstocks into a gas oil fuel. The animal fat or other feedstock is stored in a holding tank 25. The feedstock is pre-heated by a heat exchanger 35 whilst still in the holding tank 25.

The feedstock is pumped from the holding tank 25 by a pump P-2. On exiting the holding tank 25, the feedstock is further heated to a selected temperature by series of heat exchangers H-2, H-3, that also serve to cool the finished product stream at various points in the process before it reaches the finished product tank 80. The arrangement of these heat exchangers is described in greater detail below. By exchanging and conserving heat in this way, the overall energy requirements of the system are greatly reduced.

The pump P-2 operates at a variable speed to pump the feedstock to the heat recovery device (HRD) 20 at a rate that equals the volume of feedstock being converted to a fuel product during the process. In this manner, the process is maintained in continuous equilibrium.

A heating device 30, comprising a thermal oxidiser, is provided with fuel and during its normal operation generates heat by the oxidation of the fuel. The heat generated is supplied to the HRD 20, which is close coupled to the thermal oxidiser.

The feedstock passes from the pyrolysis vessel 22 and HRD 20 to a still pot 11 and a distillation column 12. The temperature of the liquid in the pyrolysis vessel is in the region of 280-400 deg.C., and is between 0.1 and 2 bar pressure.

The exhaust gases from the HRD 20 and heating device 30 pass through a heat exchanger H-1, and pump P-1 feeds the heated fluid to the holding tank heat exchanger 35.

The process is monitored and controlled automatically by a computer driven software program and receives signals from a series of electronic sensors located at various points in the process. The program then controls flow, temperature, pressure and other process parameters via electro-mechanically operated control valves and other devices.

The process control system has the ability to accurately maintain the process temperature and pressure at pre-set limits. The cracking temperature is maintained by the HRD 20 and heating device 30.

A volume of the liquor stream is extracted from the still pot by a pump P-3 typically drawn from the lower levels of the still pot where the heavier, less pure components of the feedstock will reside. The extracted liquid is circulated under pressure (typically between 0.1 and 2 bar) to a pyrolysis reaction vessel 22 in heat recovery unit 20, which heats the volume of liquor to a temperature above its normal cracking temperature (normally in the region of 280-400 deg.C.) until that point where a gas is given off. The gas from the pyrolysis vessel is returned to the still pot 11 via a pressure-reducing device 40. It is preferable to return the gas at a point beneath the surface level of the liquor already in the still pot 11.

At this point the gas expands rapidly into the liquor in the still pot, providing a fast and even mixing and distribution of heat to the liquor without the risk of coke being formed from direct external heating. After injection into the still pot, the pyrolised gas passes into the distillation apparatus.

The intention is to impart heat evenly and to maintain the cracking temperature at the lowest temperature and pressure that will allow the process to operate continuously whilst allowing only a small percentage of light ends to be produced relative to the gas oil fuel product. This also has the effect of avoiding fouling or coking of the pyrolysis vessel and associated process systems.

Under these mild process conditions, cracked products that constitute a gas oil fuel can be economically obtained.

The distillation column 12 mounted above the still pot vessel 11 is an insulated cylinder filled with industry standard packing material. The column is designed to have a height and circumference calculated to efficiently allow that volume of vapours given off from the still pot vessel to achieve the required temperature reduction gradient.

With accurate temperature control, the lower molecular weight material fractions that have a boiling point above that of the selected cracking temperature leave the top of the column 12 as vapours comprising various light ends and volatile compounds. These gases pass through a condenser 15 where the temperature is reduced sufficiently to allow most of the gases to condense into a liquid and then be collected in a flash vessel 19. The condenser includes heat exchanger H-2, which, as previously described, heats the feedstock on leaving the holding tank 25.

The flash vessel 19 is fitted with heaters that are used to control the temperature in the flash vessel so that any residual water vapour, light ends and other unwanted compounds may be selectively flashed off, resulting in the flash point of the liquid gas oil being reduced to a specified level.

The gaseous light ends can be recirculated to the inlet of the thermal oxidiser 30 as fuel for the continuing oxidisation process. Alternatively (or additionally) the light ends may be passed to another condenser 55 where they are allowed to collect as a liquid and are then passed to a holding tank 60 to be used as a liquid fuel. Any unwanted compounds are also recirculated to the inlet of the thermal oxidiser where they are burned to destruction.

The liquid product remaining in the flash vessel 19 is transferred to the reflux product vessel 50 from where a proportional volume of the liquid is removed by a pump P-4 and injected into the distillation column 12 as reflux, where it is used to assist in controlling the temperature gradient in the column 12. The pump P-4 is controlled automatically so that the flow rate of the reflux accurately maintains the contact ratio between vapours passing through the column 12 and reflux. The reflux is injected into the column 12 at a point below the top of the column where a horizontal plate distributes the reflux evenly within the column to ensure that contact between vapours and reflux is maximised.

Liquid product remaining in the reflux product vessel 50 is transferred through heat exchanger H-2 to a finished product holding tank 80. The heat exchanger H-2, as previously described, heats the feedstock immediately as it leaves the holding tank 25. The particular temperatures and pressures chosen to apply to the extracted liquor will depend upon the physical and chemical characteristics of the feedstock.

Still pot liquor may additionally be extracted by pump P-S through an additional draw-off line from the still pot and passed through the HRD 20 before being returned to the still pot. This liquor is passed through the HRD 20 at a higher velocity than the heavier, product extracted from the lower levels of the still pot vessel, allowing the still pot temperature to be more closely controlled, thereby avoiding overheating the lighter fractions and avoid fouling of the HRD 20.

The volume of the liquor stream extracted from the still pot by a pump P-3 may be maintained under pressure whilst being heated above its cracking temperature so that it does not form a gas, and introduced into the still pot where it depressurises and vapourises, causing vigorous agitation but also imparting heat and causing vaporisation of larger volumes of liquor in the still pot. The process method chosen is likely to depend on the physical characteristics of the feedstock being used.

The invention claimed is:

1. A process for converting a feedstock into gas oil fuel, including:

introducing material including the feedstock into a still pot in the form of liquor;

extracting a volume of material from the still pot, heating the extracted material under pressure to a cracking temperature before injecting it back into the still pot beneath the surface level of liquor in the still pot;

separating in a distillation column lighter molecular weight compounds from the cracked material into volatile light ends and gas oil fuel; and collecting the gas oil fuel.

2. A process according to claim 1, wherein the volume of material is heated to a cracking temperature by passing it via a first path through a heating unit and back to the still pot; and wherein the process further includes: extracting a volume of material from the still pot, passing it via a second path through said heating unit and back to the still pot; wherein the material passed through said heating unit via said second path is passed through said heating unit at a higher velocity than the material passed through the heating unit via said first path.

3. A process according to claim 2, wherein the material passed through the heating unit via the second path is extracted from the still pot at a higher level than the material passed through the heating unit via the second path.

4. A process according to claim 2, wherein the material passed through the heating unit via the second path is also returned to the still pot beneath the surface level of the liquor in the still pot.

5. A process according to claim 2, wherein the first path includes a pump between the still pot and the heating unit and a pressure reducing device between the heating unit and the still pot.

6. A process according to claim 2, wherein the first path includes a pyrolysis vessel within the heating unit, and wherein the pressure of the material in the pyrolysis vessel is at least 0.1 bar.

7. A process according to claim 1, wherein the feedstock includes animal fats.

8. A process according to claim 1, wherein the extracted material is thermally cracked under pressure in a pyrolysis vessel to a mixture of lighter molecular weight compounds, before said injection back into the still pot.

9. A process according to claim 1, wherein the volume of liquid extracted from the still pot vessel is heated to above the cracking temperature while being kept at sufficiently high pressure to remain in a balanced gas/fluid state before said injection back into the still pot.

10. A process according to claim 2, wherein the feedstock is fed from a storage tank to the heating unit prior to being fed into the still pot vessel.

11. An apparatus for converting a feedstock into gas oil fuel, including:

a still pot for receiving material including the feedstock in the form of liquor;

a heating unit;

a first path for passing a volume of material from the still pot through said heating unit for heating to a cracking temperature and injecting it back into the still pot beneath the surface level of liquor in the still pot;

a distillation column for separating lighter molecular weight compounds from the cracked material into volatile light ends and gas oil fuel; and a condenser for collecting the gas oil fuel.

12. An apparatus according to claim 11, further comprising a second path from the still pot through said heating unit and back to the still pot; and wherein the apparatus is configured to pass material from the still pot through said heating unit via said second path at a higher velocity than material passed through the heating unit via said first path.

13. An apparatus according to claim 12, wherein the second path is configured to extract material from the still pot at a higher level than the first path.

14. An apparatus according to claim 12, wherein the second path is configured to return material to the still pot beneath the surface level of the liquor in the still pot.

15. An apparatus according to claim 12, wherein the first path includes a pump between the still pot and the heating unit and a pressure reducing device between the heating unit and the still pot.

16. An apparatus according to claim 12, wherein the first path includes a pyrolysis vessel within the heating unit.

17. An apparatus according to claim 16, wherein the pyrolysis vessel is configured to thermally crack extracted under pressure to a mixture of lighter molecular weight compounds before injection back into the still pot.

18. An apparatus according to claim 11, which is configured to heat a volume of liquid extracted from the still pot to above the cracking temperature while keeping it at sufficiently high pressure to remain in a balanced gas/fluid state before d injection back into the still pot.

19. An apparatus according to claim 12, further comprising a storage tank from which feedstock is fed to the heating unit prior to being fed into the still pot.

* * * * *